US007097537B1

(12) United States Patent
David et al.

(10) Patent No.: US 7,097,537 B1
(45) Date of Patent: Aug. 29, 2006

(54) DETERMINATION OF POSITION OF SENSOR MEASUREMENTS DURING POLISHING

(75) Inventors: Jeffrey Drue David, San Jose, CA (US); Nils Johansson, Los Gatos, CA (US); Manoocher Birang, Los Gatos, CA (US); Boguslaw A. Swedek, Cupertino, CA (US); Ingemar Carlsson, Milpitas, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/922,110

(22) Filed: Aug. 18, 2004

Related U.S. Application Data

(60) Provisional application No. 60/496,311, filed on Aug. 18, 2003.

(51) Int. Cl.
*B49D 1/00* (2006.01)

(52) U.S. Cl. ..... 451/5; 451/6; 451/8; 451/9; 451/10; 451/11; 451/41; 451/286; 451/287; 451/288

(58) Field of Classification Search ..... 451/5, 451/6, 8, 9, 10, 11, 41, 286, 287, 288
See application file for complete search history.

(56) References Cited

U.S. PATENT DOCUMENTS

| | | | |
|---|---|---|---|
| 5,081,796 | A | 1/1992 | Schultz |
| 5,357,331 | A | 10/1994 | Flockencier |
| 5,413,941 | A | 5/1995 | Koos et al. |
| 5,427,878 | A | 6/1995 | Corliss |
| 5,433,651 | A | 7/1995 | Lustig et al. |
| 5,605,760 | A | 2/1997 | Roberts |
| 5,609,511 | A | 3/1997 | Moriyama et al. |
| 5,640,242 | A | 6/1997 | O'Boyle et al. |
| 5,658,183 | A | 8/1997 | Sandhu et al. |
| 5,663,797 | A | 9/1997 | Sandhu |
| 5,672,091 | A | 9/1997 | Takahashi et al. |
| 5,708,506 | A | 1/1998 | Birang |
| 5,730,642 | A | 3/1998 | Sandhu et al. |
| 5,733,171 | A | 3/1998 | Allen et al. |
| 5,762,537 | A | 6/1998 | Sandhu et al. |
| 5,791,969 | A | 8/1998 | Lund |
| 5,838,447 | A | 11/1998 | Hiyama et al. |
| 5,851,135 | A | 12/1998 | Sandhu et al. |
| 5,865,666 | A | 2/1999 | Nagahara |
| 5,872,633 | A | 2/1999 | Holzapfel et al. |

(Continued)

FOREIGN PATENT DOCUMENTS

| | | |
|---|---|---|
| EP | 0 663 265 A1 | 7/1995 |

(Continued)

*Primary Examiner*—Lee D. Wilson
*Assistant Examiner*—Shantese McDonald
(74) *Attorney, Agent, or Firm*—Fish & Richardson

(57) ABSTRACT

A chemical mechanical polishing apparatus and method can use an in-situ monitoring system. A measurement of a position of a carrier head and a sinusoidal first function can be used to define a second function that associates measurements from the series with positions on the substrate. For each measurement in a series from the in-situ monitoring system, the second function can be used to determine a position on the substrate where the measurement was taken. In addition, a measurement of the position of the carrier head, a time when the measurement of the substrate property is made, and a phase correction representing lag resulting from a processing delay in generating the measurement of the position of the carrier head can be used in determining a position on the substrate where a measurement of a substrate property was taken.

35 Claims, 9 Drawing Sheets

U.S. PATENT DOCUMENTS

| | | | | |
|---|---|---|---|---|
| 5,893,796 | A | 4/1999 | Birang et al. | |
| 5,899,792 | A | 5/1999 | Yagi | |
| 5,949,927 | A | 9/1999 | Tang | |
| 5,964,643 | A | 10/1999 | Birang et al. | |
| 6,004,187 | A | 12/1999 | Nyui et al. | |
| 6,106,662 | A | 8/2000 | Bibby et al. | |
| 6,159,073 | A | 12/2000 | Wiswesser et al. | |
| 6,280,289 | B1 | 8/2001 | Wiswesser et al. | |
| 6,494,766 | B1 | 12/2002 | Wiswesser et al. | |
| 6,503,766 | B1 | 1/2003 | Ni | |
| 6,524,165 | B1 | 2/2003 | Wiswesser et al. | |
| 6,562,185 | B1 | 5/2003 | Avanzino et al. | |
| 6,652,355 | B1 | 11/2003 | Wiswesser et al. | |
| 6,707,540 | B1 * | 3/2004 | Lehman et al. | 356/72 |
| 6,764,380 | B1 | 7/2004 | Wiswesser et al. | |
| 6,913,511 | B1 * | 7/2005 | Wiswesser et al. | 451/5 |
| 6,923,711 | B1 * | 8/2005 | Laursen et al. | 451/6 |
| 2004/0116047 | A1 | 6/2004 | Wiswesser et al. | |
| 2004/0242123 | A1 | 12/2004 | Wiswesser et al. | |

FOREIGN PATENT DOCUMENTS

| | | |
|---|---|---|
| EP | 0 738 561 A1 | 10/1996 |
| EP | 0 881 040 A2 | 12/1998 |
| EP | 0 881 484 A2 | 12/1998 |
| JP | 3-234467 | 10/1991 |

* cited by examiner

DETERMINATION OF POSITION OF SENSOR MEASUREMENTS DURING POLISHING

CROSS-REFERENCE TO RELATED APPLICATIONS

This application claims priority to U.S. Application Ser. No. 60/496,311, filed on Aug. 18, 2003, the entire disclosure of which is incorporated herein by reference.

BACKGROUND

The present invention relates generally to chemical mechanical polishing of substrates, and more particularly to methods and apparatus for monitoring a layer during chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing liquid, such as a slurry with abrasive particles, is supplied to the surface of the polishing pad.

One problem in CMP is determining whether the polishing process is complete, i.e., whether a substrate layer has been planarized to a desired flatness or thickness, or when a desired amount of material has been removed. Overpolishing (removing too much) of a conductive layer or film leads to increased circuit resistance. On the other hand, underpolishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to remove the substrate from the polishing surface and examine it. For example, the substrate can be transferred to a metrology station where the thickness of a substrate layer is measured, e.g., with a profilometer or a resistivity measurement. If the desired specifications are not met, the substrate is reloaded into the CMP apparatus for further processing. This is a time-consuming procedure that reduces the throughput of the CMP apparatus. Alternatively, the examination might reveal that an excessive amount of material has been removed, rendering the substrate unusable.

More recently, in-situ monitoring of the substrate has been performed, e.g., with optical or capacitance sensors, in order to detect the polishing endpoint. Other proposed endpoint detection techniques have involved measurements of friction, motor current, slurry chemistry, acoustics and conductivity. One detection technique that has been considered is to induce an eddy current in the metal layer and measure the change in the eddy current as the metal layer is removed.

SUMMARY

In one aspect, the invention is directed to a method of polishing that includes bringing a surface of a substrate into contact with a polishing pad, causing relative motion between the substrate and the polishing pad, using one or more in-situ monitoring sensors to generate a series of measurements of one or more properties of the substrate, associating each measurement of the series with information indicating a time when the measurement was made, generating a first measurement of a position of a carrier head holding the substrate, using the first measurement of the position of the carrier head and a sinusoidal first function to define a second function that associates measurements from the series with positions on the substrate, and for each measurement in the series, using the second function to determine a position on the substrate where the measurement was taken.

Implementations of the invention may include one or more of the following features.

The position of the carrier head may be measured with an encoder. Defining the second function may include adjusting the sinusoidal function based on the first measurement. A plurality of positions of the carrier head may be measured with the encoder. Defining the second function may include curve fitting the sinusoidal function to the plurality of encoder measured positions. The first function may be updated based on a second measurement of the position of the carrier head made after the first measurement, e.g., by calculating a phase shift. The encoder may generate position measurements with a frequency greater than 100/millisecond, e.g., about 256/millisecond. The second function may include a phase correction representing lag resulting from a processing delay in generating the first measurement of the position of the carrier head, and may include a phase shift representing variations in carrier head sweep frequency from a target sweep frequency. Measurements may be associated with positions on the substrate corresponding to an edge of the substrate. The in-situ monitoring sensor may be an eddy current sensor.

In another aspect, the invention is directed to a method of polishing that includes bringing a surface of a substrate into contact with a polishing pad, causing relative motion between the substrate and the polishing pad, using one or more in-situ monitoring sensors to generate a measurement of a substrate property, associating the measurement of the substrate property with information indicating a time when the measurement of the substrate property was made, generating a measurement of a position of a carrier head holding the substrate, and using the first measurement of the position of the carrier head, the time when the measurement of the substrate property was made, and a phase correction representing lag resulting from a processing delay in generating the measurement of the position of the carrier head in determining a position on the substrate where the measurement of the substrate property was taken.

The invention includes computer program products, tangibly stored on machine-readable medium, for operating a polishing apparatus, the product comprising instructions operable to cause a processor to perform the steps set forth above.

Possible advantages of implementations of the invention can include one or more of the following.

The optical and eddy current monitoring systems can monitor essentially the same spot on the substrate. Implementations can provide accurate conversion of time domain data to the position domain in systems using optical and non-optical (e.g., magnetic) monitoring systems. The optical monitoring system can sample relatively small zones on the substrate surface (e.g., one millimeter or less) and can determine the edge of the substrate to relatively high accuracy.

In some embodiments, the apparatus and methods may improve wafer edge detection resolution and accuracy, despite a possible decrease in the signal to noise ratio of the optical monitoring system.

The thickness of the conductive layer can be measured during bulk polishing. The thickness of a polishing pad used to polish the substrate can also be measured during polishing. The pressure profile applied by the carrier head can be adjusted to compensate for non-uniform polishing rates and non-uniform thickness of the incoming substrate. Polishing can be stopped with high accuracy. Over-polishing and under-polishing can be reduced, as can dishing and erosion, thereby improving yield and throughput.

Other features and advantages of the invention will become apparent from the following description, including the drawings and claims.

BRIEF DESCRIPTION OF THE DRAWINGS

Like reference symbols in the various drawings indicate like elements.

DETAILED DESCRIPTION

Figure 1:
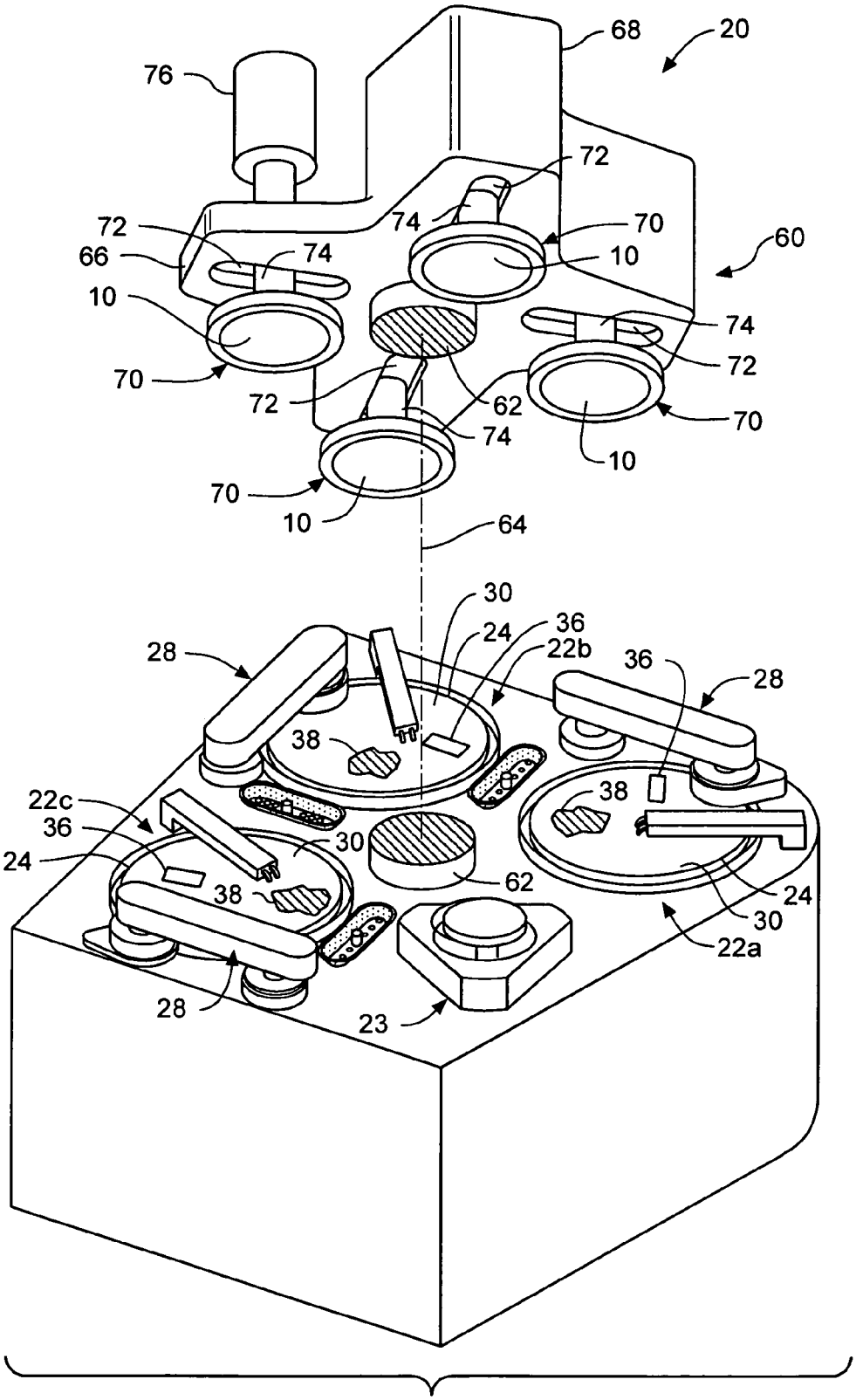
FIG. 1 is a schematic exploded perspective view of a chemical mechanical polishing apparatus.

Referring to FIG. 1, one or more substrates 10 can be polished by a CMP apparatus 20. A description of a similar polishing apparatus 20 can be found in U.S. Pat. No. 5,738,574, the entire disclosure of which is incorporated herein by reference. Polishing apparatus 20 includes a series of polishing stations 22*a*, 22*b* and 22*c*, and a transfer station 23.

Each polishing station includes a rotatable platen 24 on which is placed a polishing pad 30. The first and second stations 22*a* and 22*b* can include a two-layer polishing pad with a hard durable outer surface or a fixed-abrasive pad with embedded abrasive particles. The final polishing station 22*c* can include a relatively soft pad or a two-layer pad. Each polishing station can also include a pad conditioner apparatus 28 to maintain the condition of the polishing pad so that it will effectively polish substrates.

Figure 2A:
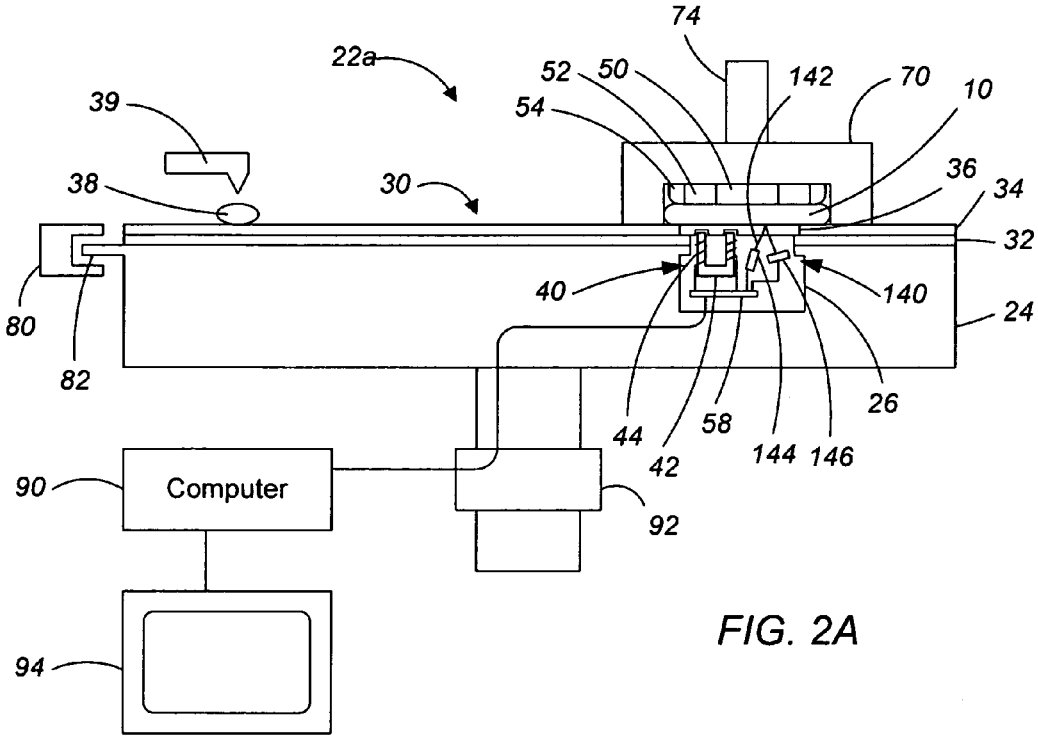
FIG. 2A is a schematic side view, partially cross-sectional, of a chemical mechanical polishing station that includes an eddy current monitoring system and an optical monitoring system.

Referring to FIG. 2A, a two-layer polishing pad 30 typically has a backing layer 32 which abuts the surface of platen 24 and a covering layer 34 which is used to polish substrate 10. Covering layer 34 is typically harder than backing layer 32. However, some pads have only a covering layer and no backing layer. Covering layer 34 can be composed of foamed or cast polyurethane, possibly with fillers, e.g., hollow microspheres, and/or a grooved surface. Backing layer 32 can be composed of compressed felt fibers leached with urethane. A two-layer polishing pad, with the covering layer composed of IC-1000 and the backing layer composed of SUBA-4, is available from Rohm & Hass Electronic Components (IC-1000 and SUBA—are product names of Rohm & Hass).

During a polishing step, a polishing liquid 38, such as an abrasive slurry or abrasive-free solution can be supplied to the surface of the polishing pad 30 by a slurry supply port or combined slurry/rinse arm 39. The same slurry solution may be used at the first and second polishing stations, whereas another slurry solution may be used at the third polishing station.

Returning to FIG. 1, a rotatable multi-head carousel 60 supports four carrier heads 70. The carousel is rotated by a central post 62 about a carousel axis 64 by a carousel motor assembly (not shown) to orbit the carrier head systems and the substrates attached thereto between polishing stations 22 and transfer station 23. Three of the carrier head systems receive and hold substrates, and polish them by pressing them against the polishing pads. Meanwhile, one of the carrier head systems delivers a polished substrate to the transfer station 23 and receives an unpolished substrate from the transfer station 23.

Each carrier head 70 is connected by a carrier drive shaft 74 to a carrier head rotation motor 76 (shown by the removal of one quarter of cover 68) so that each carrier head can independently rotate about it own axis. In addition, each carrier head 70 independently laterally oscillates in a radial slot 72 formed in carousel support plate 66. A description of a suitable carrier head 70 can be found in U.S. Pat. Nos. 6,422,927 and 6,450,868, and in U.S. patent application Ser. No. 09/712,389, filed Nov. 13, 2000, the entire disclosures of which are incorporated by reference. In operation, the platen is rotated about its central axis, and the carrier head is rotated about its central axis and translated laterally across the surface of the polishing pad.

Figure 2B:
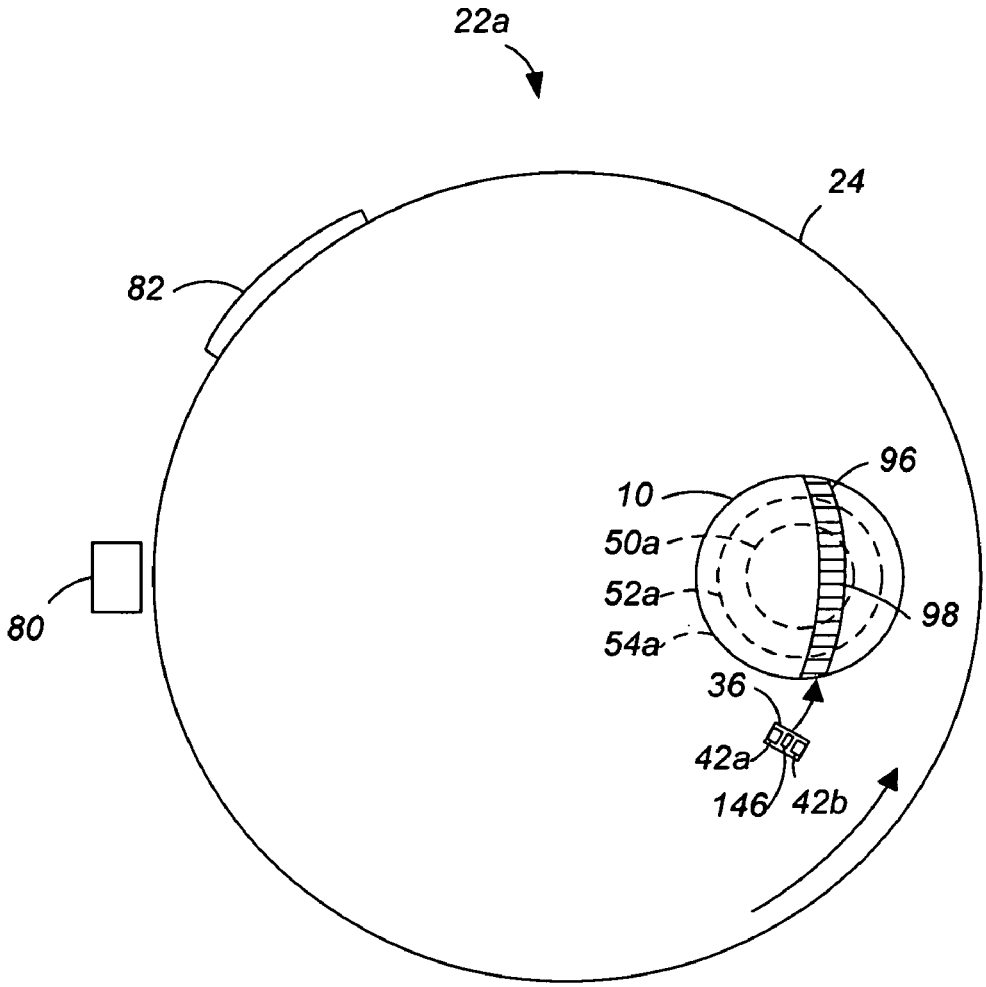
FIG. 2B is a schematic top view of a platen from the polishing station of FIG. 2A.

Referring to FIGS. 2A and 2B, a recess 26 is formed in the platen 24. In addition, a transparent section 36 is formed in the polishing pad 30 overlying the recess 26. The transparent section 36 is positioned such that it passes beneath the substrate 10 during a portion of the platen's rotation, regardless of the translational position of the carrier head. Assuming that polishing pad 32 is a two-layer pad, the transparent section 36 can be constructed by cutting an aperture in the backing layer 32, and by replacing a section of the cover layer 34 with a transparent plug. The plug can be a relatively pure polymer or polyurethane, e.g., formed without fillers. In general, the material of the transparent section 36 should be non-magnetic and non-conductive. In addition, the system can include a cover 27, e.g., of glass or a hard plastic, that is placed over recess 26, with a top of the cover flush with the top of the platen 24. The eddy current sensor can extend through the cover 27 and into the transparent section 36 of the polishing pad as shown, or alternatively the eddy current sensor can extend partially into but not through the cover 27.

Referring to FIG. 2A, at least one of the polishing stations, e.g., the first polishing station 22*a* or the second polishing station 22*b*, includes an in-situ eddy current monitoring system 40 and an optical monitoring system 140. The eddy current monitoring system 40 and optical monitoring system 140 can function as a polishing process control and endpoint detection system. The first polishing station 22*a* can include just an eddy current monitoring system, and the final polishing station 22*c* can include just an optical monitoring system, although either may additionally include an eddy current monitoring system or only an eddy current monitoring system or only an optical monitoring system.

As shown by FIG. 2B, core 42 and window section 36 sweep beneath the substrate 10 with each rotation of the platen. Each time the window section sweeps beneath the substrate, data can be collected from eddy current monitoring system 40 and optical monitoring system 140.

Returning to FIG. 2A, eddy current monitoring system 40 induces and senses eddy currents in a metal layer on the substrate. The monitoring system 40 includes a core 42 positioned in recess 26 to rotate with the platen, and a coil 44 wound around core 42. The coil 44 is connected to a control system, such as that described in U.S. patent application Ser. No. 10/633,276, filed Jul. 31, 2003, the entire disclosure of which is incorporated by reference. In brief, the control system can include an oscillator to drive the coil 44 and various sensing components such as a capacitor connected in parallel with coil 46, an RF amplifier, and a diode. Various components of the control system, such as the oscillator, capacitor, RF amplifier, and diode can be located on a printed circuit board 160 inside the recess 26. A computer 90 can be coupled to the components in the platen, including printed circuit board 160, through a rotary electrical union 92.

Figure 3:
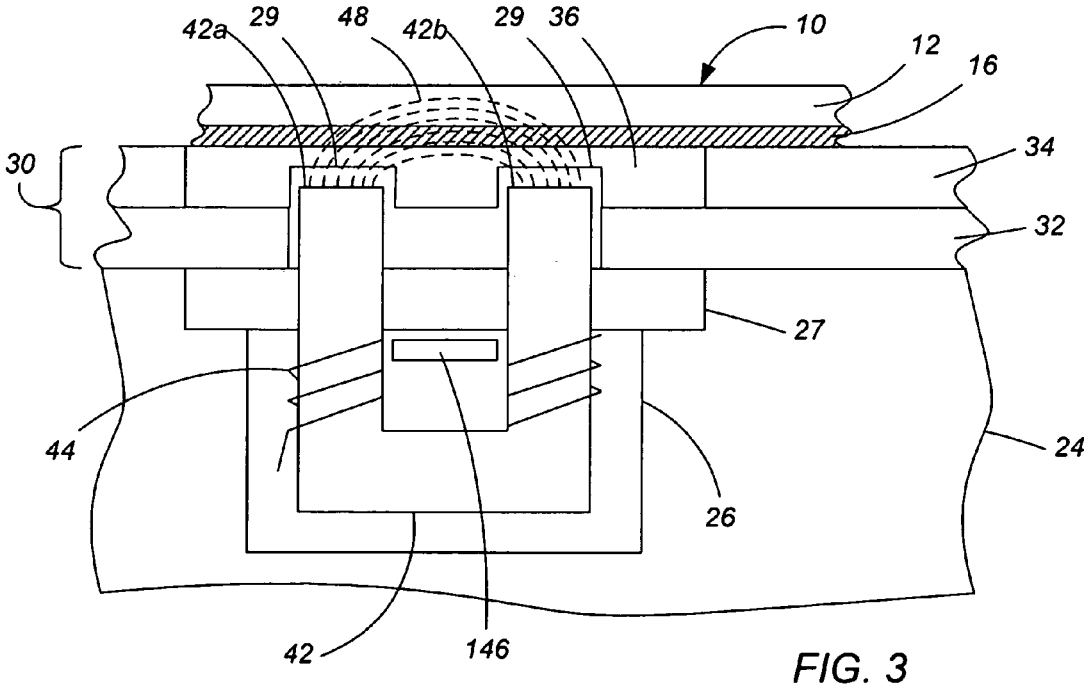
FIG. 3 is a schematic cross-sectional view illustrating a magnetic field generated by the eddy current monitoring system.

Referring to FIG. 3, core 42 can be a U-shaped body formed of a non-conductive material with a relatively high magnetic permeability. The driving coil can be designed to match the driving signal from the oscillator. The exact winding configuration, core composition and shape, and capacitor size can be determined experimentally. As shown, the lower surface of transparent section 36 may include two rectangular indentations 29, and the two prongs 42*a* and 42*b* of core 42 may extend into the indentations so as to be positioned closer to the substrate.

Returning to FIG. 2A, in operation, the oscillator drives the coil 44 to generate an oscillating magnetic field 48 that extends through the body of core 42 and into the gap 46 between the two poles 42*a* and 42*b* of the core. At least a portion of magnetic field 48 extends through thin portion 36 of polishing pad 30 and into substrate 10. If a metal layer 12 is present on substrate 10, oscillating magnetic field 48 generates eddy currents in the metal layer 12. The eddy currents cause the metal layer 12 to act as an impedance source that is coupled to the sense circuitry in the controller. As the thickness of the metal layer changes, the impedance changes. By detecting this change, the eddy current sensor can sense the change in the strength of the eddy currents, and thus the change in thickness of metal layer 12.

Figure 4A:
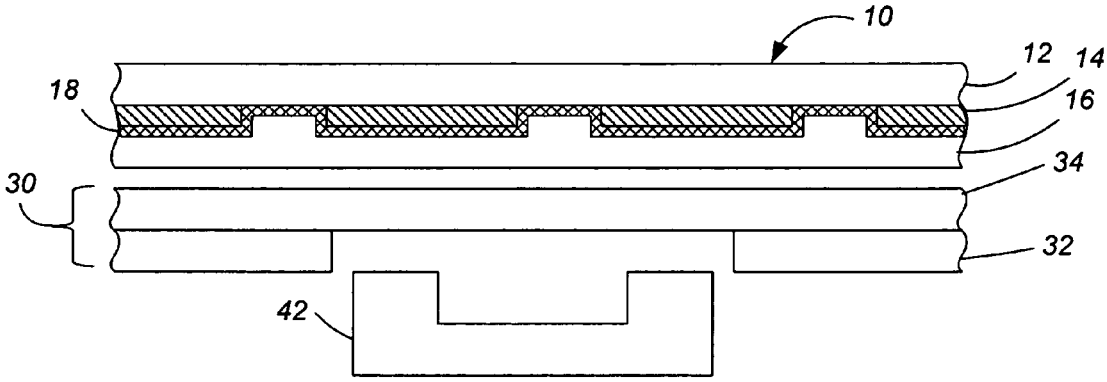
FIGS. 4A–4D schematically illustrate a method of detecting a polishing endpoint using an eddy current sensor.
Figure 4B:
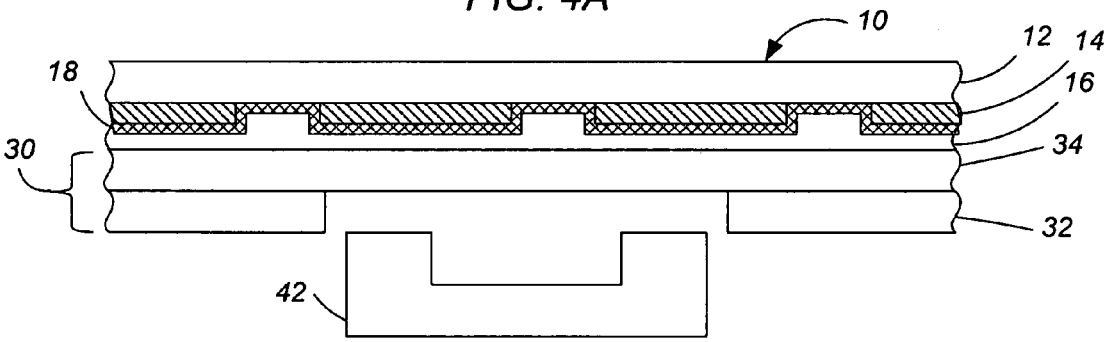

As shown in FIGS. 4A and 4B, for a polishing operation, the substrate 10 is placed in contact with the polishing pad 30. The substrate 10 can include a silicon wafer 12 and a conductive layer 16, e.g., a metal such as copper, disposed over one or more patterned underlying layers 14, which can be semiconductor, conductor or insulator layers. A barrier layer 18, such as tantalum or tantalum nitride, may separate the metal layer from the underlying patterned layers.

After polishing, the patterned underlying layers will provide metal features, e.g., vias, pads and interconnects. However, prior to polishing the bulk of conductive layer 16 is initially relatively thick and continuous and has a low resistivity, and relatively strong eddy currents can be generated in the conductive layer 16. As previously mentioned, the eddy currents cause the metal layer to function as an impedance source in parallel with the coil 44.

Referring to FIG. 4B, as the substrate 10 is polished, the bulk portion of the conductive layer 16 is thinned. As the conductive layer 16 thins, its sheet resistivity increases, and the eddy currents in the metal layer become dampened. Consequently, the coupling between metal layer 16 and the sensor is reduced (i.e., increasing the resistivity of the virtual impedance source).

Figure 4C:
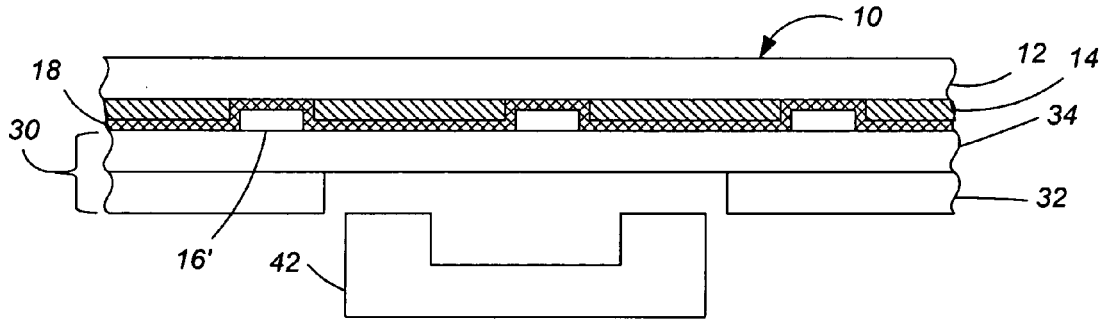

Referring to FIG. 4C, eventually the bulk portion of the conductive layer 16 is removed, exposing the barrier layer 18 and leaving conductive interconnects 16' in the trenches between the patterned insulative layer 14. At this point, the coupling between the conductive portions in the substrate, which are generally small and generally non-continuous, and the sensor reaches a minimum.

Figure 4D:
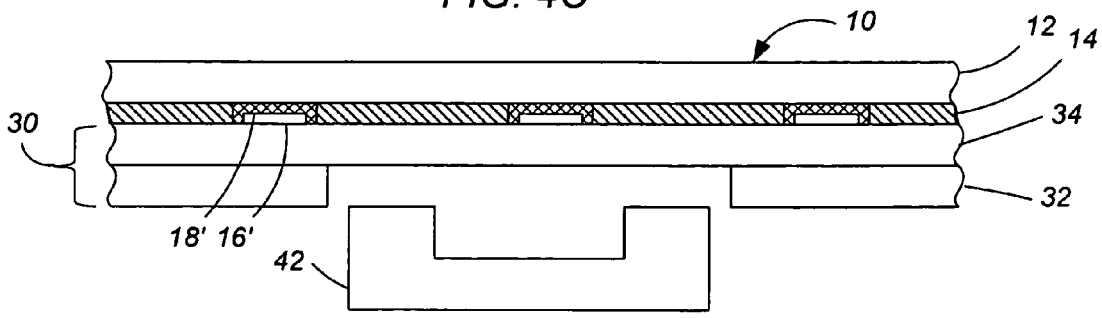

Referring to FIG. 4D, continued polishing removes the barrier layer 18 and exposes the underlying insulative layer 14, leaving conductive interconnects 16' and buried barrier layer films 18' in the trenches between the patterned insulative layer 14.

Figure 6:
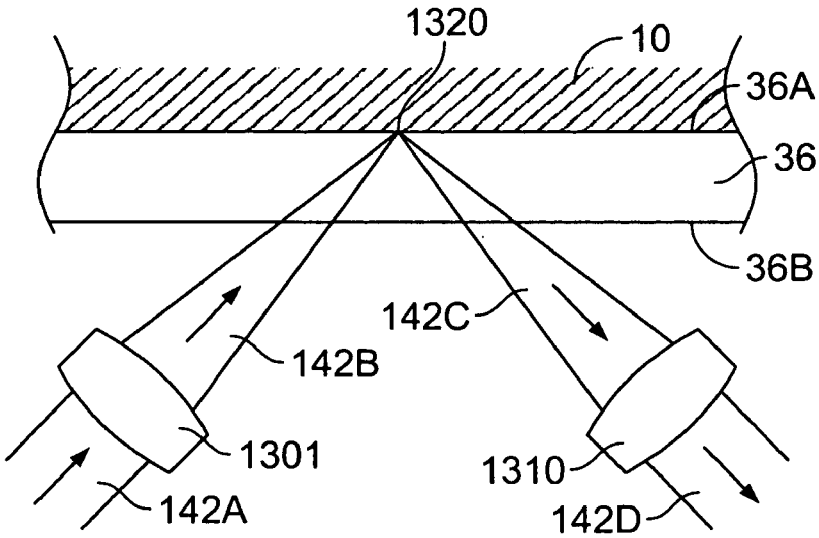
FIG. 6 is a schematic side view of components of an optical monitoring system.

Referring to FIGS. 2A and 6, optical monitoring system 140, which can function as a reflectometer or interferometer, can be secured to platen 24 in recess 26 with eddy current monitoring system 40. Optical monitoring system 140 includes a light source 144, a detector 146, a focusing optic 1301, and a collimating optic 1310. The electronics for light source 144 and detector 146 may be located on printed circuit board 160. The light source generates a light beam 142 which propagates through transparent window section 36 and slurry to impinge upon the exposed surface of the substrate 10. In some implementations, light source 144 is a laser and light beam 142 may be a collimated laser beam. In certain implementations, light source 144 is an incoherent light source (e.g., a fluorescent bulb or arc lamp). In such implementations, light emitted from the incoherent light source can be collimated using one or more collimating stops, reflectors and/or collimating lenses, thereby illuminating focusing optic 1301 with a collimated beam.

Referring also to FIG. 6, focusing optic 1301 focuses light beam 142 to reduce the spot size of beam 142 on the exposed surface of substrate 10 relative to the unfocused beam. Collimating optic 1310 collimates beam 142 after it reflects from the surface of substrate 10.

The spot size of a beam can be defined as the beam diameter within which, e.g., 80% of the beam power is contained. Generally, spot size depends on the wavelength of the beam, and the nature of the focusing optic. For example, where the focusing optic is a lens, the fraction of a beam's power, P, in a beam with a Gaussian profile within a diameter D is given by $$P(D) = 1 - \exp\left(-\frac{1}{2}\left(\frac{\pi a D}{\lambda F}\right)^2\right),$$

where F is the lens focal length and a is the unfocused beam's radius. In some implementations, where the light beam has a wavelength between about 400 nanometers and 800 nanometers (e.g., 633 nanometers or 670 nanometers) the beam spot size is less than about two millimeters (e.g., less than about one millimeters, 0.5 millimeters, 0.2 millimeters).

Referring now specifically to FIG. 6, initially light beam 142, shown as 142A, is substantially collimated before being focused by focusing optic 1301. Focused beam 142B is substantially transmitted through transparent section 36 and contacts the surface of substrate 10 at position 1320. In embodiments where focusing optic 1301 is a lens, position 1320 preferably coincides with the lens's focal length so that the spot size of the beam at the point it contacts the substrate surface is minimized. More generally, the beams dimension transverse to its propagation direction is smaller at the surface 36A where substrate 10 contacts transparent section 36 than at the opposite window surface 36B. Upon reflection from the surface of substrate 10, beam 142C expands while it propagates back through transparent section 36. Collimating optic 1310 recollimates reflected beam 142C, directing collimated beam 142D towards the detector.

In some embodiments, focusing optic 1301 and collimating optic 1310 are lenses with similar focal lengths (e.g., with identical focal lengths). More generally, focusing optic 1301 and/or collimating optic 1301 can include any optical component or combination of optical components that focus the light beam to reduce the spot size of the beam at surface 36A of transparent section 36. Such optical components include refractive optical components (e.g., lenses), reflective optical components (e.g., focusing mirrors), diffractive optical components (e.g., gratings), and/or holographic optical components (e.g., holographic gratings).

Figure 7A:
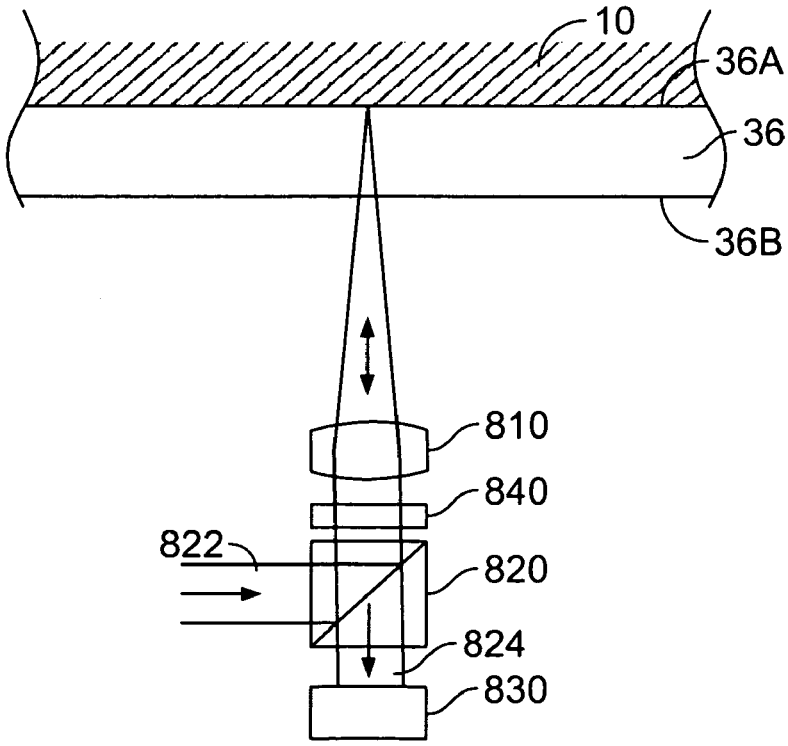
FIG. 7A is a schematic side view of components of another embodiment of an optical monitoring system.

In FIG. 6, focusing optic 1301 and collimating optic 1310 are shown as being separate components, and separate from transparent section 36. In some embodiments however, a single optic can be used to both focus the light beam and recollimate the reflected light beam. For example, and with reference to FIG. 7A, where the beam is substantially normally incident on the substrate surface, a single lens 810 can be used. In such cases, a beam splitter 820 (e.g., a polarizing beam splitter used with a quarter wave plate 840 and a polarized light beam) can be used to direct the reflected beam to the detector without completely blocking the incoming beam. Beam splitter 820 directs the incoming beam 822 through lens 810 towards transparent section 36. The reflected beam 824 is transmitted through beam splitter 820 and is detected by a detector 830.

Figure 7B:
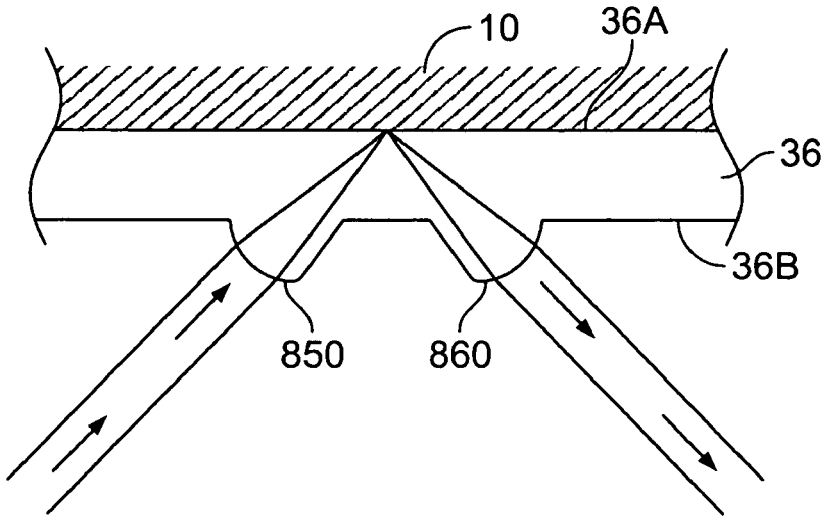
FIG. 7B is a schematic side view of components of a further embodiment of an optical monitoring system.

In some embodiments, optics can be integrated with the window. For example, one or more of the optics can be bonded to surface 36B of the window (e.g., using an optical adhesive). Another example of integrated components are where the focusing and/or collimating optics are formed in the window from a monolithic piece of the window material. Such an embodiment is shown in FIG. 7B, where a focusing lens 850 and a collimating lens 860 are formed in transparent section 36. Such components can be achieved by grinding a focusing surface into surface 36B of the window or by molding transparent section 36 to include one or more focusing surfaces, for example.

Referring again to FIG. 2A, light beam 142 can be projected from laser 144 at a non-zero angle measured from an axis normal to the surface of substrate 10. In addition, if hole 26 and transparent section 36 are elongated, a beam expander (not illustrated) may be positioned in the path of the light beam to expand the light beam along the elongated axis of the window.

Although the optical monitoring system described above includes collimating optic 1310, other embodiments can have no collimating optic between the window and the detector.

Figure 5B:
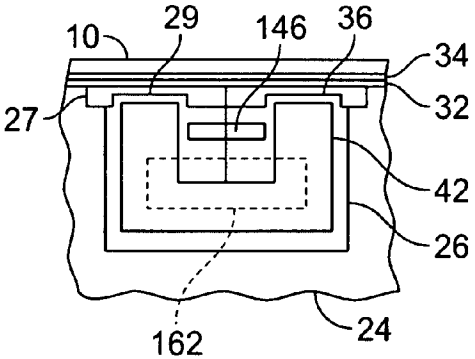
FIGS. 5A–5C are cross-sectional views of a platen with an optical and eddy current monitoring system.
Figure 5A:
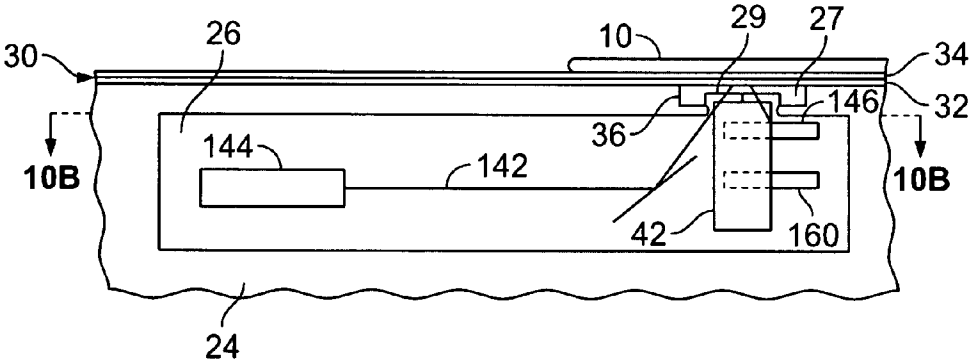
Figure 5C:
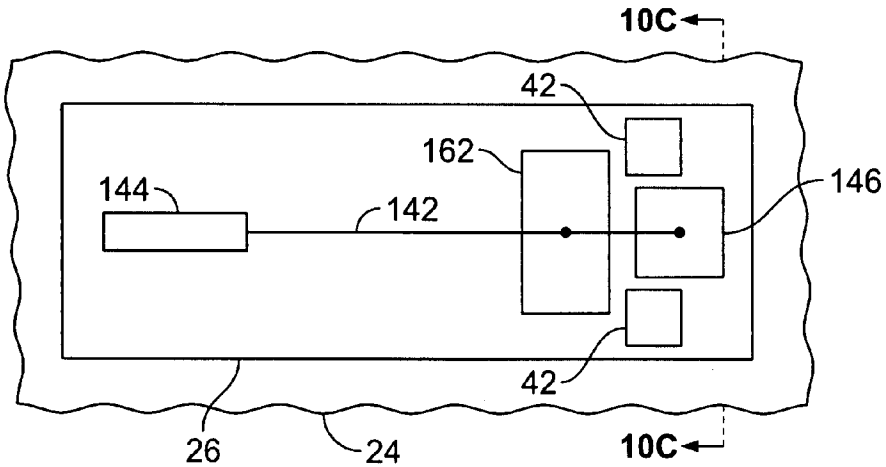

Referring to FIGS. 5A–5C, optical monitoring system 140 can be positioned so that light beam 142 impinges the substrate at a position between two prongs 43 of core 42. In one implementation, light source 144 is positioned to direct light beam 142 toward core 42 along a path substantially parallel to the surface of platen 24. The light beam 142 is reflected upwardly from a mirror 162 positioned just before core 42 so that light beam 142 passes between prongs 43, is reflected from substrate 10, and then impinges a detector 146 that has at least a portion positioned between prongs 43. In this configuration, the light beam is directed to a spot on the substrate inside a region covered by the magnetic field from the core. Consequently, the optical monitoring system 140 can measure the reflectivity of substantially the same location on the substrate as is being monitored by the eddy current monitoring system 40. Although not illustrated, core 42 and detector 146 can be mounted on or attached to one or more printed circuit boards 160.

Returning to FIGS. 2A and 2B, the CMP apparatus 20 can also include a position sensor 80, such as an optical interrupter, to sense when core 42 and light source 44 are beneath substrate 10. For example, the optical interrupter could be mounted at a fixed point opposite carrier head 70. A flag 82 is attached to the periphery of the platen. The point of attachment and length of flag 82 is selected so that it interrupts the optical signal of sensor 80 while transparent section 36 sweeps beneath substrate 10. The sensor 80 can monitor for an interruption in the optical signal at a fixed sampling rate, which can be set by the operator or manufacturer. For example, the sensor 80 can be configured to make one measurement per millisecond, or more than one measurement per millisecond, such as more than 100 measurements per millisecond, e.g., 256 measurements per millisecond. Operating the sensor 80 with a frequency of 256 measurements per millisecond typically provides a window position resolution of 0.004 millimeters (assuming that the platen is turning 60 rotations per minute), which can provide more accurate window position information.

The information provided by the position sensor can be useful in various aspects of CMP control. For example, the duration that the optical signal is interrupted and/or the time between sweeps provides the CMP apparatus with information about the angular velocity, $\omega_p$, of the platen. Specifically, if the flag 82 is of a known angular arc, $\Phi$, and the optical signal is interrupted for a duration $T_{interrupt}$, then the angular velocity can be calculated as $\Phi/T_{interrupt}$. Similarly, if the time between the start of subsequent optical interruptions is $T_{sweep}$, then the angular velocity can be calculated as $1/T_{sweep}$. The calculated angular velocity can be compared against the target angular velocity set by the polishing recipe and used for closed loop control of the platen rotation velocity, or compared against the angular velocity as determined from an encoder attached to the platen drive system and used to correct for drift or inaccuracy in the encoder measurements. The angular velocity can also be used in calculations of the measurement positions, as discussed below.

Optionally, the high resolution position sensor can provide information to a computer (for example the one described below), which can use the information to provide real time process control. As an alternative or in addition to the described optical position sensor, the CMP apparatus can include an encoder to determine the angular position of platen.

A general purpose programmable digital computer 90 receives the signals from the eddy current sensing system and the optical monitoring system. The printed circuit board 160 can include circuitry, such as a general purpose microprocessor or an application-specific integrated circuit, to convert the signals from the eddy current sensing system and optical monitoring system into digital data. This digital data can be assembled into discrete packets which are sent to computer 90 via a serial communication channel, e.g., RS-232. So long as both printed circuit board 160 and computer 90 use the same packet format, computer 90 can extract and use the intensity and phase shift measurements in the endpoint or process control algorithm. For example, each packet can include five bytes, of which two bytes are optical signal data, two bytes are either amplitude or phase difference data for the eddy current signal, one bit indicates whether the packet includes amplitude or phase shift data, and the remaining bits include flags for whether window section 36 is beneath the substrate, check-sum bits, and the like.

Since the monitoring systems sweep beneath the substrate with each rotation of the platen, information on the metal layer thickness and exposure of the underlying layer is accumulated in-situ and on a continuous real-time basis (once per platen rotation). The computer 90 can be programmed to sample measurements from the monitoring system when the substrate generally overlies transparent section 36 (e.g., as determined by the position sensor). As polishing progresses, the reflectivity or thickness of the metal layer changes, and the sampled signals vary with time. The time varying sampled signals may be referred to as traces. The measurements from the monitoring systems can be displayed in real time (or near real time) on an output device 94 during polishing to permit the operator of the device to visually monitor the progress of the polishing operation. (The display can also indicate detected errors and polishing parameters such as, for example, pressures, slurry flow, temperature, platen rotation speed.) The traces may be used to control the polishing process and determine the end-point of the metal layer polishing operation, as will be described below.

In operation, CMP apparatus 20 uses eddy current monitoring system 40 and optical monitoring system 140 to determine when the bulk of the filler layer has been removed and to determine when the underlying stop layer has been substantially exposed. The computer 90 applies process control and endpoint detection logic to the sampled signals to determine when to change process parameter and to detect the polishing endpoint. Possible process control and endpoint criteria for the detector logic include local minima or maxima, changes in slope, threshold values in amplitude or slope, or combinations thereof.

In addition, computer 90 can be programmed to associate each measurement from eddy current monitoring system 40 and optical monitoring system 140 from each sweep beneath the substrate with a radial position on the substrate, as described in U.S. Pat. Nos. 6,159,073, and 6,280,289, the entire disclosures of which are incorporated herein by references. Once the measurements are associated with radial positions, computer 90 can be programmed to sort the measurements into radial ranges, to determine minimum, maximum and average measurements for each sampling zone, and to use multiple radial ranges to determine the polishing endpoint, as discussed in U.S. Pat. No. 6,399,501, the entirety of which is incorporated herein by reference.

Figure 8:
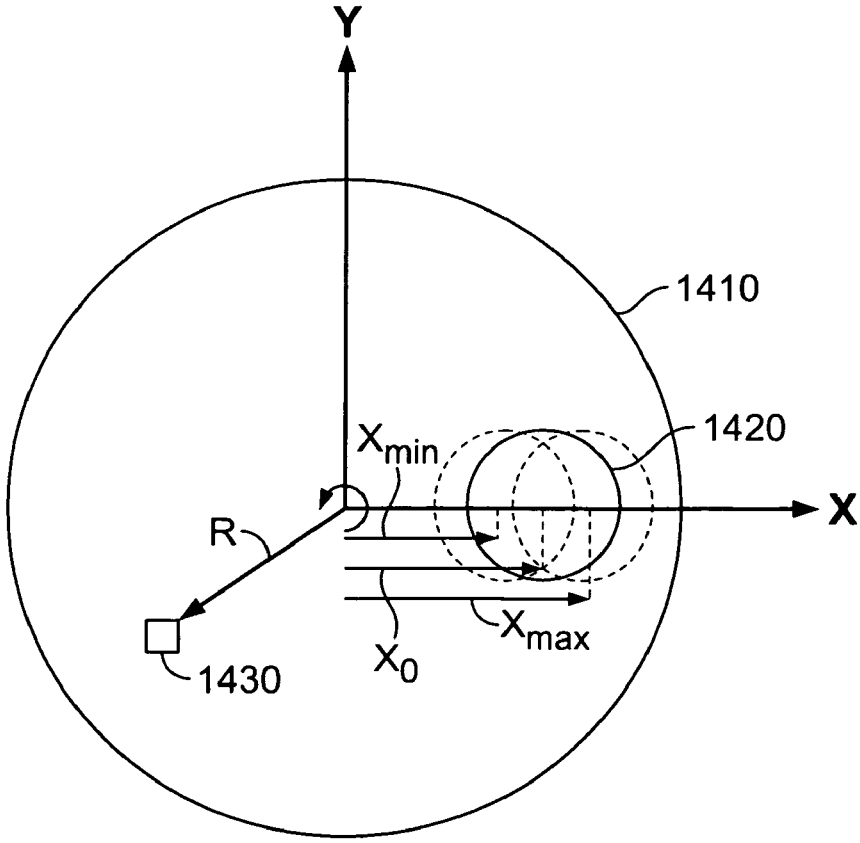
FIG. 8 is a schematic view of a wafer's position relative to an optical monitoring system during polishing.

To associate the measurements with radial positions on the substrate surface, computer 90 first collects the data (e.g., eddy current or light intensity values) as a function of time, t, from a complete scan across the retaining ring and substrate from both optical monitoring system 140 and eddy current monitoring system 40. The computer determines, for each data point collected (i.e., each current or intensity value measured), the radial position of the sensor relative to the center of the wafer according to the following algorithm, which is described with reference to FIG. 8, in which a Cartesian co-ordinate system is located with its origin coincident with the rotation axis of a platen 1410. In FIG. 8, the center of the wafer 1420 is situated on the x-axis. During polishing, the back and forth motion of the carrier head in its radial slot causes the head to sweep the wafer center between a minimum x-coordinate, $X_{min}$, and a maximum x-coordinate, $X_{max}$. Accordingly, the position of the wafer center as a function of time is given by $$x''(t)=X_0-\Delta X\cos(\omega_w t+C) \quad \text{(Equ. 1)}$$

where $X_0=(X_{max}+X_{min})/2$ and $\Delta X=(X_{max}-X_{min})/2$, $\omega_w$ is the head sweep frequency, and C is a correction term. As the platen rotates, the position of a sensor 1430, e.g., the eddy current sensor or the optical sensor, located a distance R from the platen rotation axis, is given by $$x'(t)=R\cos\omega_p t$$

$$y'(t)=R\sin\omega_p t' \quad \text{(Equ. 2)}$$

where $\omega_p$ is the platen angular velocity. The platen angular velocity $\omega_p$ can be taken from the polishing recipe, or derived from data collected by the position sensor as described above.

The radial coordinate in the position domain is then given by $$r(t)=\sqrt{(x'(t)-x''(t))^2+y'(t)^2}.$$

This data provides a mapping from time domain to position domain, allowing the system user to associate intensity measurements and corresponding eddy current sensor measurements with a radial position on the wafer.

Returning to the determination of the head position, the above described function (i.e., Equation 1) can be used in conjunction with discrete encoder-measured head positions, for example, by curve fitting, to provide an accurate mapping between time and position domains. The curve fit can be updated as each encoder-measured head position is collected. To map a time associated with an eddy current and/or light intensity measurement, the computer inputs the measurement time and the head sweep frequency into Equation 1. The head sweep frequency $\omega_w$, head position offset $X_0$ and head sweep $\Delta X$ can be taken from the polishing recipe.

The foregoing algorithm assumes constant $\omega_v$ and $\omega_p$ during each sweep of the optical monitoring system relative to the substrate. The correction term, C, is optionally included to correct for offsets between the wafer position calculated based on the head sweep frequency, $\omega_w$, and the head position as determined from a position encoder coupled to the polishing head. (The later measures and indicates the measured position of the wafer center along the x-axis described above in reference to FIG. 8.) Such offsets can occur, for example, due to variations in $\omega_w$ and/or due to delays in processing that can occur when the control system is busy. In some embodiments, the correction term, C, can be a function of one or both of the calculated head position, x"(t) and the encoder-measured head position, M(t).

For example, each time a new head position measurement is obtained from the encoder, the correction term C can be updated. For example, the correction value $C_i$ for calculations of the head position measurement x"(t) after time $t_i$ can be calculated as $$C_i = \frac{x''(t_{i-1}) - M(t_{i-1})}{4\frac{\partial x''(t_{i-1})}{\partial t}}.$$

where $M(t_{i-1})$ is the most recent encoder-measured head position, and $x''(t_{i-1})$ is the head position as calculated using the previous version of x"(t) (i.e., using $C_{i-1}$) at time $t_{i-1}$.

The correction term, C, can have other functional dependences on x"(t) and/or M(t), for example, C can depend on the ratio of these values or functions of these values. The correction term can depend on higher order derivatives of x"(t) or on derivatives of M(t). The function form of the correction term can be determined empirically or theoretically.

In one implementation, the system accounts for a processing delay that causes an error in the time that is attributed to each encoder-measured head position separately from the curve fitting correction term C. Specifically, the processing delay causes the attributed time to include a lag, and the actual time of measurement occurs earlier than the attributed time. To correct for this lag, a phase correction, $\phi$, is defined so that the above described function for calculating head position is phase shifted to the left to accommodate the lag, i.e., $$x''(t)=X_0-\Delta X\cos(\omega_w t+C+\phi)$$

Note that, instead of phase shifting the function, the time inputted into above described function of Equation 1 to calculate head position can be adjusted to account for the lag. In this case, the computer calculates head position for measurement at time $t_i$ as a function of $(t_i+\Delta t)$. As described above, the lag can be determined empirically. Specifically, the value of the correction term ($\phi$ or $\Delta t$) is adjusted until a trace in the time domain correctly indicates the edge position. For example, given a 300 mm wafer, the trace should have one edge at the −150 mm position and another at the +150 mm position (assuming the coordinate system of FIG. 8).

The computer can further reduce inaccuracies in the position data by identifying reflection measurements associated with the edge of the substrate, and rescaling the calculated positions based on the known size of the substrate. For example, for a 300 mm wafer, the two edge measurements are associated with the 150 mm radial position. Similarly, for a 200 mm diameter wafer, the two edge measurements are associated with the 100 mm radial position. The computer compares the calculated positions for measurements corresponding to the substrate edge and scales each of the calculated intermediate positions proportionally so that the edge measurements correspond to the substrate's known radius. Thus, each scaled radial measurement r'(t) for a measurement taken at time t can be calculated as $r'(t)=r(t)*[R/r(T_{edge})]$, where R is the substrate radius and $T_{edge}$ is the time of one of the edge measurements, e.g., the closer edge.

Figure 9A:
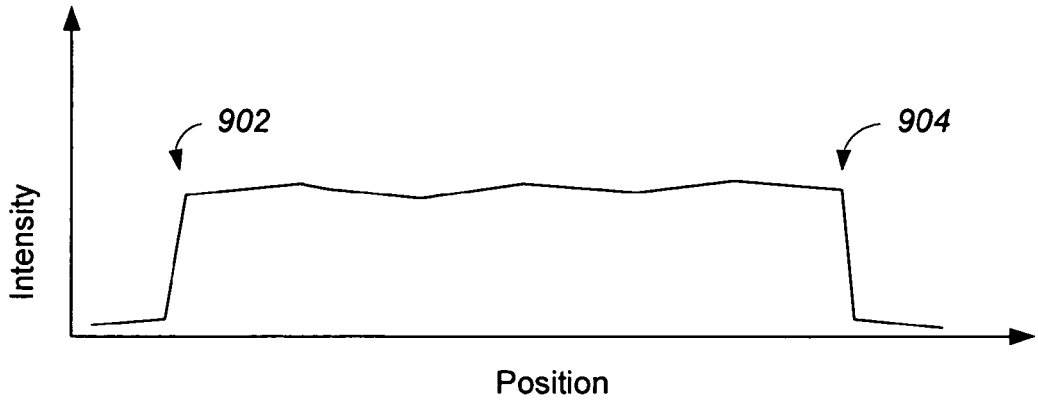
FIGS. 9A–9C illustrate a technique for improving the accuracy of calculated positions of measurements.
Figure 9B:
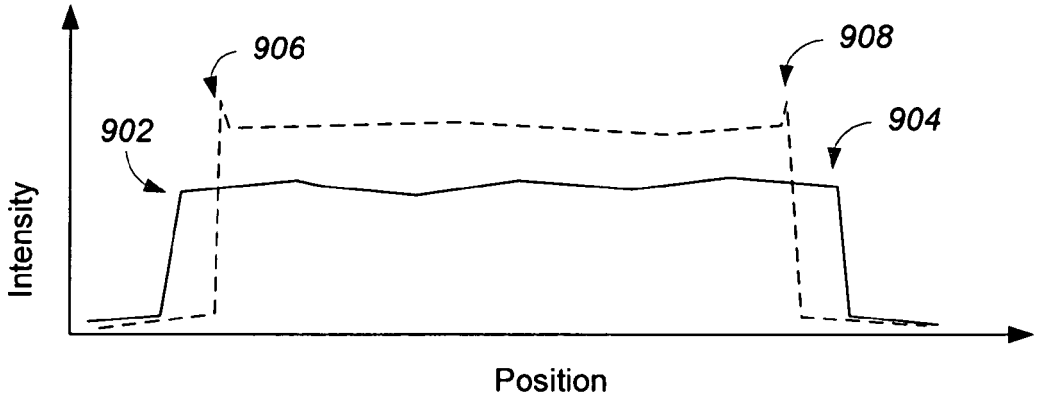
Figure 9C:
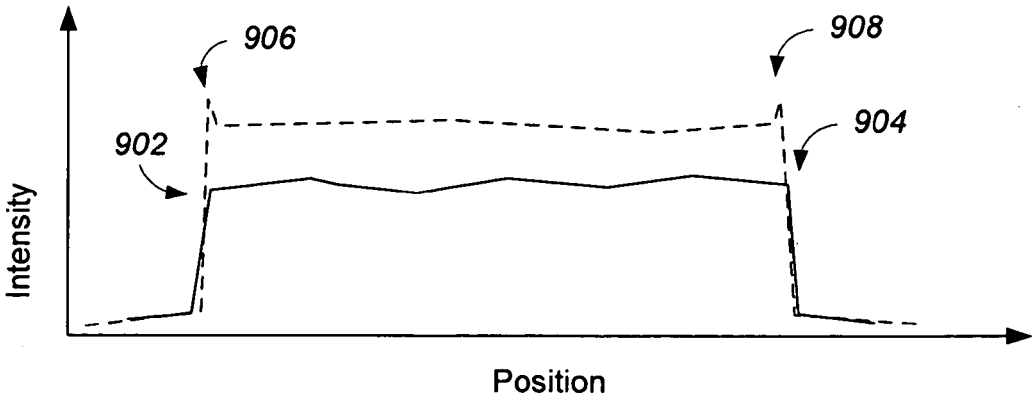

FIGS. 9A–9C illustrate the above described scaling technique. FIG. 9A shows the above described calculated positions, including the 150 mm positions 902 and 904 (assuming that the measure substrate is a 300 mm wafer). FIG. 9B shows the reflection measurements, including the two measurements 906 and 908 associated with the substrate edge, superimposed over the calculated positions. As can be seen, the calculated positions need to be scaled down to fit between the reflection measurements 906 and 908. FIG. 9C shows the scaled down calculated positions.

Alternatively, the computer can apply techniques other than the above described one to scale the calculated positions. For example, the computer can calculate a length delimited by the first and last calculated positions and a length delimited by the two reflection measurements associated with the substrate edges. The computer can the scale the calculated positions according to a ratio of the two lengths.

In order to identify the reflection measurements associated with the edge of the substrate, the computer looks at the variation in detected intensity for adjacent measurements. Typically, the reflection measurements from the substrate edge correspond to two sudden changes in the intensity where the light beam transitions from to reflecting from the retaining ring of the carrier head to reflecting from the substrate. For oxide polishing, for example, because the retaining ring surface is typically highly reflective, the reflections from the retaining ring correspond to the highest intensity reflection measurements. Thus, the initial sudden transition from a high intensity to a low intensity should indicate the leading edge of the substrate, whereas the later sudden transition from a low intensity to a high intensity should indicate the trailing edge of the substrate. Of course, the reverse may be true (particularly for metal polishing), as the relative reflectivity of the retaining ring and substrate depend on their material properties and the polishing process. Measurements of intermediate reflectance acquired between the retaining ring measurements correspond to the substrate surface.

In some embodiments, the intensity of light reflected from the retaining ring is more than about 20% greater than that reflected from the substrate (e.g., more than about 30%, such as about 40% or more). Based on the intensity change from the retaining ring to the wafer surface, a user can define a threshold intensity or intensity ratio to allow the system to identify measurements corresponding to the edge of the wafer. This threshold and/or intensity ratio can be adjusted to account for detector sensitivity, light source intensity, signal to noise ratio, etc.

The above described scaling technique can also be implemented by using measurements from eddy current sensors. Specifically, the eddy current sensors can detect the presence of a retaining ring, which usually includes a metal backing ring. As the substrate is held inside the inner diameter of the retaining ring, the computer can use retaining ring edge information to identify substrate edges and scale calculated positions as described above.

Figure 10:
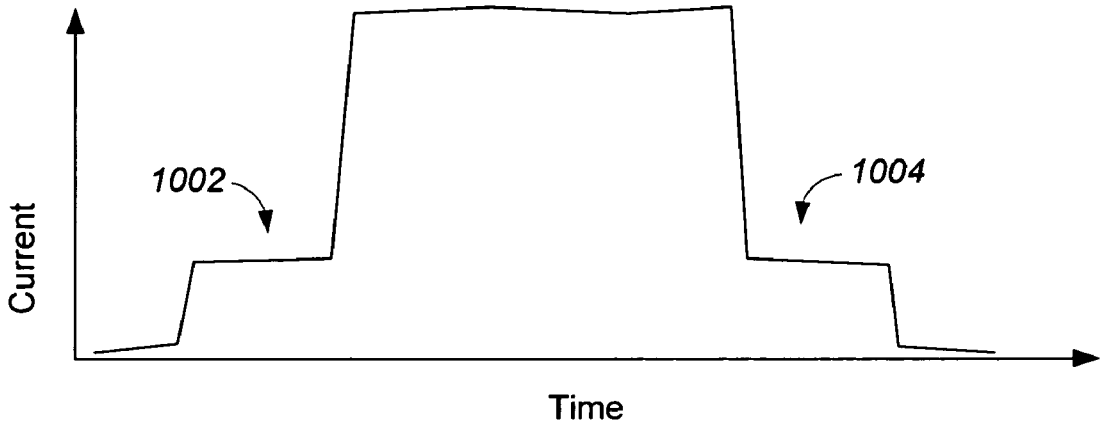
FIG. 10 shows an example of eddy current measurements for one sweep.

FIG. 10 shows an example of eddy current measurements for one sweep. As can be seen, the magnitude of the current increases when the sensor passes from the carrier head to the retaining ring at the start of a sweep, and decreases when the sensor passes from the retaining ring to the carrier head at the end of the sweep. The portions 1002 and 1004 are associated with the retaining ring edges. The computer can use a threshold current or threshold current ratio to identify eddy current measurements that correspond to retaining ring edges.

More generally, the scaling technique can be performed based on a determination of the substrate edge using the same sensor that generated the data being scaled, or based on a determination of the substrate edge using a different sensor from the sensor that generated the data being scaled. Moreover, the scaling technique is applicable to both oxide polishing and conductive polishing, e.g., data from either an optical sensor or an eddy current sensor can be scaled. In particular, for oxide polishing, the eddy current sensor can be used to find the retaining ring edge, and the optical data could be scaled accordingly. On the other hand, where there is a sharp difference in reflectivity between the substrate and retaining ring (e.g., typical for metal polishing, but also possible for oxide polishing), the optical system can be used to find the wafer edge by detecting the retaining ring edge.

Using the eddy current sensor to identify eddy sensor measurements associated with substrate edges can avoid problems typically present when using an optical sensor. One problem, for example, is that the optical sensor is typically not situated at the exact same spatial position as is the eddy current sensor. The eddy current measurement consequently is taken at a position on the substrate that does not exactly correspond to the position measured by the optical sensor, and there is thus an in inherent systematic error in the computer's calculation. Furthermore, the difference between the two sensors can vary from one in-situ monitoring module to another.

The foregoing paragraphs describe one algorithm for mapping time domain measurements to the position domain. Other mapping algorithms can also be used. For example, in some embodiments, a linear mapping can be used to transform the time domain measurements to position domain. In a linear mapping algorithm, to associate the remaining measurements the computer can simply assume a linear relationship between the time domain and the position domain. Thus, the position P(t) can be calculated as a linear interpolation $$P(t) = \frac{D}{(T_2 - T_1)}(t - T_1),$$

where D is the substrate diameter, t is the time of the particular measurement, $T_1$ is the measurement time for the initial edge and $T_2$ is the measurement time for the trailing edge.

Each measurement by the monitoring systems covers an associated sampling zone on the substrate. Due to focusing the light beam of the monitoring system to reduce its spot size on the surface of substrate 10, the size of the sampling zones is reduced compared to a substantially similar system that does not focus the light beam. The size of the sampling zone is the distance the beam traverses along the beam path direction during the acquisition of one reflection measurement data point. The reduction in sampling zone size provides a corresponding increase in resolution in the reflection measurements made by the system using the optical monitoring system. Improved resolution may be particularly advantageous in embodiments where the optical measurements are used to identify the position of the wafer edges in a scan because, e.g., the portion of the substrate surface probed by the eddy current sensor can be determined to greater accuracy using the time domain to position domain conversion described above.

In addition to beam spot size on the substrate surface, sampling zone size depends on the acquisition rate of the detector and the rotational velocity of the platen. In embodiments, the sampling zone size may be less than about two millimeters in length (e.g., less than about one millimeter, 0.5 millimeters, 0.2 millimeters). The data acquisition rate for the optical monitoring system and/or eddy current sensor can be greater than 500 Hz (e.g., greater than about 1,000 Hz, such as up to 5,000 Hz). In general, for a light beam of constant intensity, and where the reflectance of the substrate surface does not dramatically change, the detector signal will be reduced at higher acquisition rates. The detector signal is reduced due to the corresponding reduction of detector integration time at these higher acquisition rates, which leads to reduced detected intensity for each data point. Thus, in order for the optical monitoring system to acquire data at higher acquisition rates, more sensitive detectors or more intense light sources may be used. In some embodiments, the data acquisition rate can be a variable parameter that can be selected by a user of the CMP apparatus. In such cases, the sensitivity of the detector and/or intensity of the light source may be adjustable parameters as well in order to accommodate varying acquisition rates. In such implementations, these parameters can be adjusted by the system operator, or can be adjusted based on a feedback signal derived from, e.g., the detector signal.

Computer 90 may also be connected to the pressure mechanisms that control the pressure applied by carrier head 70, to carrier head rotation motor 76 to control the carrier head rotation rate, to the platen rotation motor (not shown) to control the platen rotation rate, or to slurry distribution system 39 to control the slurry composition supplied to the polishing pad. Specifically, after sorting the measurements into radial ranges, information on the metal film thickness can be fed in real-time into a closed-loop controller to periodically or continuously modify the polishing pressure profile applied by a carrier head, as discussed in U.S. patent application Ser. No. 09/609,426, filed Jul. 5, 2000, the entirety of which is incorporated herein by reference. For example, the computer could determine that the endpoint criteria have been satisfied for the outer radial ranges but not for the inner radial ranges. This would indicate that the underlying layer has been exposed in an annular outer area but not in an inner area of the substrate. In this case, the computer could reduce the diameter of the area in which pressure is applied so that pressure is applied only to the inner area of the substrate, thereby reducing dishing and erosion on the outer area of the substrate.

The eddy current and optical monitoring systems can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there could be a fluid bearing between the platen and polishing pad during polishing. The polishing pad can be a standard (e.g., polyurethane with or without fillers) rough pad, a soft pad, or a fixed-abrasive pad. Rather than tuning when the substrate is absent, the drive frequency of the oscillator can be tuned to a resonant frequency with a polished or unpolished substrate present (with or without the carrier head), or to some other reference.

Although illustrated as positioned in the same hole, optical monitoring system 140 could be positioned at a different location on the platen than eddy current monitoring system 40. For example, optical monitoring system 140 and eddy current monitoring system 40 could be positioned on opposite sides of the platen, so that they alternately scan the substrate surface.

Various aspects of the invention, such as placement of the coil on a side of the polishing surface opposite the substrate or the measurement of a phase difference, still apply if the eddy current sensor uses a single coil. In a single coil system, both the oscillator and the sense capacitor (and other sensor circuitry) are connected to the same coil.

Although in the foregoing embodiment the optical monitoring system is used in conjunction with an eddy current sensor, the optical monitoring can also be used with other non-optical monitoring systems, such as, e.g., thermal sensors, electric sensors, pressure sensors.

The present invention has been described in terms of a preferred embodiment. The invention, however, is not limited to the embodiment depicted and described. Rather, the scope of the invention is defined by the appended claims.

What is claimed is:

1. A method of polishing, comprising:

bringing a surface of a substrate into contact with a polishing pad, the substrate being held by a carrier head;

causing relative motion between the substrate and the polishing pad;

using one or more in-situ monitoring sensors to generate a series of measurements of one or more properties of the substrate;

associating each measurement of the series with information indicating a time when the measurement was made;

generating a plurality of carrier-head position measurements, each of which indicating a position of the carrier head;

curve fitting a sinusoidal first function to the plurality of carrier-head position measurements to define a second function for associating measurements from the series with positions on the substrate; and for each measurement in the series, using the second function to determine a position on the substrate where the measurement was taken.

2. The method of claim 1, wherein generating the plurality of carrier-head position measurements includes measuring the carrier head position with an encoder.

3. The method of claim 2, wherein the encoder generates position measurements with a frequency greater than 100/millisecond.

4. The method of claim 3, wherein the encoder generates position measurements with a frequency of about 256/millisecond.

5. The method of claim 1, further comprising adjusting the sinusoidal first function based on a measured frequency at which the carrier head sweeps back and forth.

6. The method of claim 5, wherein adjusting the sinusoidal first function includes including a correction factor that compensates for a variation in the platen rotation rate.

7. The method of claim 1, further comprising updating the first function based on a measurement of the position of the carrier head made after the plurality of carrier-head position measurements was taken.

8. The method of claim 1, wherein determining the position on the substrate where the measurement was taken includes calculating a phase adjustment associated with the generation of the plurality of carrier-head position measurements.

9. The method of claim 1, wherein the first function includes a phase correction representing lag resulting from a processing delay.

10. The method of claim 9, wherein generating the measurement of the position of the carrier head includes measuring the position with an encoder.

11. The method of claim 9, wherein defining the second function includes compensating for variations in carrier head sweep frequency from a target sweep frequency.

12. The method of claim 1, further comprising associating property measurements with positions on the substrate corresponding to an edge of the substrate.

13. The method of claim 1, wherein the in-situ monitoring sensor comprises an eddy current sensor.

14. The method of claim 1, wherein the position on the substrate where the measurement was taken is indicated by information that specifies a radius.

15. A method of polishing, comprising:

bringing a surface of a substrate into contact with a polishing pad, the substrate being held by a carrier head;

causing relative motion between the substrate and the polishing pad;

using an in-situ monitoring sensor to generate a measurement of a substrate property;

associating the measurement of the substrate property with information indicating a time when the measurement of the substrate property was made;

generating a measurement of a position of the carrier head; and using the first measurement of the position of the carrier head, the time when the measurement of the substrate property was made, and a phase adjustment representing lag resulting from a processing delay in generating the measurement of the position of the carrier head in determining a position on the substrate where the measurement of the substrate property was taken.

16. The method of claim 15, wherein the phase adjustment is implemented by a phase correction or a time correction.

17. The method of claim 15, wherein determining a position on the substrate where the measurement of the substrate property was taken includes compensating for a difference between a measured carrier-head sweep frequency and a target carrier-head sweep frequency.

18. The method of claim 15, wherein determining a position on the substrate where the measurement of the substrate property was taken includes compensating for a difference between a measured platen rotation rate and a target platen rotation rate.

19. The method of claim 15, wherein determining a position on the substrate where the measurement of the substrate property was taken includes compensating for variations in carrier-head sweep frequency.

20. A computer program product, tangibly stored on machine-readable medium, for operating a polishing apparatus, the product comprising instructions operable to cause a processor to:

bring a surface of a substrate into contact with a polishing pad, the substrate being held by a carrier head;

cause relative motion between the substrate and the polishing pad;

receive a series of measurements of one or more properties of the substrate from one or more in-situ monitoring sensors;

associate each measurement of the series with information indicating a time when the measurement was made;

receive a plurality of carrier-head position measurements, each indicating a position of the carrier head;

curve fit a sinusoidal first function to the plurality of carrier-head position measurements to define a second function for associating measurements from the series with positions on the substrate; and for each measurement in the series, use the second function to determine a position on the substrate where the measurement was taken.

21. The product of claim 20, wherein the plurality of carrier-head position measurements are taken with an encoder.

22. The product of claim 21, wherein the encoder generates position measurements with a frequency greater than 100/millisecond.

23. The product of claim 21, wherein the encoder generates position measurements with a frequency of about 256/millisecond.

24. The product of claim 20, further comprising instructions to adjust the sinusoidal first function based on a measured frequency at which the carrier head sweeps back and forth.

25. The product of claim 20, further comprising instructions to update the first function based on a measurement of the position of the carrier head made after the plurality of carrier-head position measurements was taken.

26. The product of claim 20, wherein instructions to determine the position on the substrate where the measurement was made include instructions to calculate a phase adjustment associated with the generation of the plurality of carrier-head position measurements.

27. The product of claim 20, wherein the first function includes a phase correction representing lag resulting from a processing delay.

28. The product of claim 20, wherein instructions to define the second function includes instructions to compensate for variations in carrier head sweep frequency from a target sweep frequency.

29. The product of claim 20, further comprising instructions to associate property measurements with positions on the substrate corresponding to an edge of the substrate.

30. The product of claim 20, wherein the in-situ monitoring sensor comprises an eddy current sensor.

31. A computer program product, tangibly stored on machine-readable medium, for operating a polishing apparatus, the product comprising instructions operable to cause a processor to:

bring a surface of a substrate into contact with a polishing pad, the substrate being held by a carrier head;

cause relative motion between the substrate and the polishing pad;

receive a measurement of a substrate property from an in-situ monitoring sensor;

associate the measurement of the substrate property with information indicating a time when the measurement of the substrate property was made;

receive a measurement of a position of the carrier head; and use the first measurement of the position of the carrier head, the time when the measurement of the substrate property was made, and a phase adjustment representing lag resulting from a processing delay in generating the measurement of the position of the carrier head in determining a position on the substrate where the measurement of the substrate property was taken.

32. The product of claim 31, wherein the phase adjustment is implemented by a phase correction or a time correction.

33. The product of claim 31, wherein instructions to determine a position on the substrate where the measurement of the substrate property was taken include instructions to compensate for a difference between a measured carrier-head sweep frequency and a target carrier-head sweep frequency.

34. The product of claim 31, wherein instructions to determine a position on the substrate where the measurement of the substrate property was taken include instructions to compensate for a difference between a measured platen rotation rate and a target platen rotation rate.

35. The product of claim 31, wherein instructions to determine a position on the substrate where the measurement of the substrate property was taken include instructions to compensate for compensating for variations in carrier-head sweep frequency.

* * * * *